US008780011B2

(12) United States Patent
Yoshino et al.

(10) Patent No.: US 8,780,011 B2
(45) Date of Patent: Jul. 15, 2014

(54) ANTENNA DEVICE

(75) Inventors: Yoshitaka Yoshino, Tokyo (JP); Koichi Mukai, Ishikawa (JP); Chisato Komori, Ishikawa (JP); Satoru Tsuboi, Kanagawa (JP)

(73) Assignee: Sony Corporation, Tokyo (JP)

( * ) Notice: Subject to any disclaimer, the term of this patent is extended or adjusted under 35 U.S.C. 154(b) by 347 days.

(21) Appl. No.: 13/320,065

(22) PCT Filed: May 19, 2010

(86) PCT No.: PCT/JP2010/058423

§ 371 (c)(1),
(2), (4) Date: Nov. 11, 2011

(87) PCT Pub. No.: WO2010/134538

PCT Pub. Date: Nov. 25, 2010

(65) Prior Publication Data

US 2012/0050133 A1 Mar. 1, 2012

(30) Foreign Application Priority Data

May 20, 2009 (JP) ..... P2009-122568
May 20, 2009 (JP) ..... P2009-122569

(51) Int. Cl.
*H01Q 1/00* (2006.01)

(52) U.S. Cl.
USPC ..... 343/905; 343/711

(58) Field of Classification Search
USPC ..... 343/905, 906, 711
See application file for complete search history.

(56) References Cited

U.S. PATENT DOCUMENTS

| | | | |
|---|---|---|---|
| 2008/0122711 | A1 | 5/2008 | Kimura et al. |
| 2009/0058759 | A1 | 3/2009 | Morikawa |

FOREIGN PATENT DOCUMENTS

| | | | |
|---|---|---|---|
| EP | 1 515 393 | A1 | 3/2005 |
| EP | 1 624 586 | A1 | 2/2006 |
| EP | 2 120 422 | A1 | 11/2009 |
| EP | 2 194 601 | A2 | 6/2010 |
| JP | 2001-168982 | A | 6/2001 |
| JP | 2001-274704 | A | 10/2001 |
| JP | 2002-151932 | A | 5/2002 |
| JP | 2005-136907 | A | 5/2005 |
| JP | 2005-159727 | A | 6/2005 |
| JP | 2005-341067 | A | 12/2005 |
| JP | 2009-055535 | A | 3/2009 |
| WO | WO 2007/138669 | A1 | 12/2007 |
| WO | WO 2008/108261 | A1 | 9/2008 |

OTHER PUBLICATIONS

Woodward et al., Line Cord Antenna With Improved Dipole-Like Performance. 2180 R.C.A. Technical Notes. Oct. 23, 1983., No. 1335, 2 pages.

*Primary Examiner* — Dieu H Duong
(74) *Attorney, Agent, or Firm* — Wolf, Greenfield & Sacks, P.C.

(57) ABSTRACT

An antenna device receives broadcast waves with a sufficiently wide frequency band and sufficient gain by connecting wire material. The antenna device includes a power supply cord which can transmit power, a connecting portion, a high-frequency signal cable for extracting a high-frequency signal from the connecting portion, and a high-frequency blocking portion disposed in two places in the length direction of the power supply cord.

19 Claims, 17 Drawing Sheets

| | Vertical polarization | | | | | | | |
|---|---|---|---|---|---|---|---|---|
| Freq[MHz] | 76 | 78.5 | 81 | 83.5 | 86 | 95 | 101 | 107 |
| Peak[dBd] | −11.24 | −12.04 | −12.43 | −12.15 | −12.10 | −12.85 | −13.67 | −14.04 |

| | Horizontal polarization | | | | | | | |
|---|---|---|---|---|---|---|---|---|
| Freq[MHz] | 76 | 78.5 | 81 | 83.5 | 86 | 95 | 101 | 107 |
| Peak[dBd] | −28.24 | −29.00 | −28.98 | −28.33 | −27.70 | −27.25 | −26.74 | −25.50 |

BUNDLED STATE

| | Vertical polarization | | | | | | | |
|---|---|---|---|---|---|---|---|---|
| Freq[MHz] | 76 | 78.5 | 81 | 83.5 | 86 | 95 | 101 | 107 |
| Peak[dBd] | −16.60 | −17.04 | −17.23 | −16.95 | −16.90 | −16.25 | −16.40 | −16.30 |

| | Horizontal polarization | | | | | | | |
|---|---|---|---|---|---|---|---|---|
| Freq[MHz] | 76 | 78.5 | 81 | 83.5 | 86 | 95 | 101 | 107 |
| Peak[dBd] | −22.04 | −23.04 | −23.45 | −23.57 | −23.90 | −23.85 | −24.74 | −24.84 |

| | Vertical polarization | | | | | | | |
|---|---|---|---|---|---|---|---|---|
| Freq[MHz] | 76 | 78.5 | 81 | 83.5 | 86 | 95 | 101 | 107 |
| Peak[dBd] | −19.44 | −20.24 | −20.45 | −20.35 | −20.30 | −19.25 | −18.80 | −17.97 |

| | Horizontal polarization | | | | | | | |
|---|---|---|---|---|---|---|---|---|
| Freq[MHz] | 76 | 78.5 | 81 | 83.5 | 86 | 95 | 101 | 107 |
| Peak[dBd] | −27.80 | −28.67 | −29.83 | −29.95 | −30.30 | −29.65 | −30.00 | −29.17 |

| | Vertical polarization | | | | | | |
|---|---|---|---|---|---|---|---|
| Freq[MHz] | 76 | 78.5 | 81 | 83.5 | 86 | 95 | 101 | 107 |
| Peak[dBd] | −11.24 | −12.04 | −12.43 | −12.15 | −12.10 | −12.85 | −13.67 | −14.04 |

| | Horizontal polarization | | | | | | |
|---|---|---|---|---|---|---|---|
| Freq[MHz] | 76 | 78.5 | 81 | 83.5 | 86 | 95 | 101 | 107 |
| Peak[dBd] | −28.24 | −29.00 | −28.98 | −28.33 | −27.70 | −27.25 | −26.74 | −25.50 |

| | Vertical polarization | | | | | | |
|---|---|---|---|---|---|---|---|
| Freq[MHz] | 470 | 520 | 570 | 620 | 670 | 720 | 770 | 906 |
| Peak[dBd] | −10.53 | −13.29 | −15.64 | −15.81 | −12.92 | −11.55 | −20.25 | −18.63 |

| | Horizontal polarization | | | | | | |
|---|---|---|---|---|---|---|---|
| Freq[MHz] | 470 | 520 | 570 | 620 | 670 | 720 | 770 | 906 |
| Peak[dBd] | −6.60 | −3.69 | −2.64 | −5.48 | −8.20 | −9.15 | −10.25 | −13.58 |

ANTENNA GAIN FOR TWO CABLES ON SET SIDE BUNDLED unit: dBd (A)

BUNDLED STATE (B)

| | Vertical polarization | | | | | | | |
|---|---|---|---|---|---|---|---|---|
| Freq[MHz] | 76 | 78.5 | 81 | 83.5 | 86 | 95 | 101 | 107 |
| Peak[dBd] | −16.60 | −17.04 | −17.23 | −16.95 | −16.90 | −16.25 | −16.40 | −16.30 |

| | Horizontal polarization | | | | | | | |
|---|---|---|---|---|---|---|---|---|
| Freq[MHz] | 76 | 78.5 | 81 | 83.5 | 86 | 95 | 101 | 107 |
| Peak[dBd] | −22.04 | −23.04 | −23.45 | −23.57 | −23.90 | −23.85 | −24.74 | −24.84 |

| | Vertical polarization | | | | | | | |
|---|---|---|---|---|---|---|---|---|
| Freq[MHz] | 470 | 520 | 570 | 620 | 670 | 720 | 770 | 906 |
| Peak[dBd] | −6.93 | −12.11 | −11.46 | −12.54 | −8.36 | −9.60 | −18.25 | −19.88 |

| | Horizontal polarization | | | | | | | |
|---|---|---|---|---|---|---|---|---|
| Freq[MHz] | 470 | 520 | 570 | 620 | 670 | 720 | 770 | 906 |
| Peak[dBd] | −6.73 | −5.00 | −3.75 | −8.14 | −8.52 | −5.55 | −8.45 | −16.93 |

ANTENNA GAIN FOR ALL (THREE) CABLES BUNDLED unit: dBd

| | Vertical polarization | | | | | | |
|---|---|---|---|---|---|---|---|
| Freq[MHz] | 76 | 78.5 | 81 | 83.5 | 86 | 95 | 101 | 107 |
| Peak[dBd] | −19.44 | −20.24 | −20.45 | −20.35 | −20.30 | −19.25 | −18.80 | −17.97 |

| | Horizontal polarization | | | | | | |
|---|---|---|---|---|---|---|---|
| Freq[MHz] | 76 | 78.5 | 81 | 83.5 | 86 | 95 | 101 | 107 |
| Peak[dBd] | −27.80 | −28.67 | −29.83 | −29.95 | −30.30 | −29.65 | −30.00 | −29.17 |

| | Vertical polarization | | | | | | |
|---|---|---|---|---|---|---|---|
| Freq[MHz] | 470 | 520 | 570 | 620 | 670 | 720 | 770 | 906 |
| Peak[dBd] | −8.93 | −14.51 | −14.95 | −15.14 | −10.72 | −13.62 | −20.25 | −20.41 |

| | Horizontal polarization | | | | | | |
|---|---|---|---|---|---|---|---|
| Freq[MHz] | 470 | 520 | 570 | 620 | 670 | 720 | 770 | 906 |
| Peak[dBd] | −4.93 | −3.80 | −2.24 | −6.61 | −8.36 | −5.58 | −9.25 | −17.38 |

| | Vertical polarization | | | | | | |
|---|---|---|---|---|---|---|---|
| Freq[MHz] | 76 | 78.5 | 81 | 83.5 | 86 | 95 | 101 | 107 |
| Peak[dBd] | −14.68 | −15.87 | −16.43 | −16.55 | −16.50 | −17.25 | −18.40 | −18.84 |

| | Horizontal polarization | | | | | | |
|---|---|---|---|---|---|---|---|
| Freq[MHz] | 76 | 78.5 | 81 | 83.5 | 86 | 95 | 101 | 107 |
| Peak[dBd] | −26.72 | −28.27 | −29.05 | −29.17 | −29.30 | −30.45 | −30.20 | −29.24 |

| | Vertical polarization | | | | | | |
|---|---|---|---|---|---|---|---|
| Freq[MHz] | 470 | 520 | 570 | 620 | 670 | 720 | 770 | 906 |
| Peak[dBd] | −4.73 | −7.40 | −6.84 | −7.54 | −8.07 | −4.98 | −14.85 | −10.63 |

| | Horizontal polarization | | | | | | |
|---|---|---|---|---|---|---|---|
| Freq[MHz] | 470 | 520 | 570 | 620 | 670 | 720 | 770 | 906 |
| Peak[dBd] | −5.80 | −3.29 | −2.46 | −2.94 | −4.07 | −4.35 | −5.05 | −4.98 |

ANTENNA DEVICE

TECHNICAL FIELD

The present invention relates to an antenna device which receives electric waves using a power supply cord for power supply.

BACKGROUND ART

In recent years, tuners whereby high-definition (HD) television video can be viewed have come to be included even in notebook personal computers (PC) and small televisions, and there is increased demand to be able to view television pictures from anywhere even within a room where a user wants to receive.

Also, examples of electronic devices having television functions include small electronic devices such as PNDs (Personal Navigation Devices) and so forth, besides cellular phones and notebook PCs.

Cellular phones and so forth which can receive digital television broadcasts and radio broadcasts receive broadcast waves at an internal antenna or external antenna. Here, internal antennas have an advantage in that the design of the cellular phone is not compromised.

However, internal antennas have a disadvantage in that sensitivity deteriorates as compared to external antennas, influence of internal noise can readily be received, and so forth.

On the other hand, examples of external antennas include rod antennas. Rod antennas have features wherein sensitivity and so forth excel as compared to internal antennas.

However, rod antennas have a disadvantage such that the design of the electronic device such as a cellular phone or the like is compromised, and further the antenna protrudes.

With regard to external antennas, it has been proposed in PTLs 1 through 5 and so forth for a power supply cord to be used as an antenna.

An antenna device using this power supply cord can receive electric wave signals of the FM band transmitted from a broadcast station, and a VHF band through a UHF band used for receiving a digital television broadcast.

CITATION LIST

Patent Literature

PTL 1: Japanese Unexamined Patent Application Publication No. 2005-341067

PTL 2: Japanese Unexamined Patent Application Publication No. 2002-151932

PTL 3: Japanese Unexamined Patent Application Publication No. 2001-274704

PTL 4: Japanese Unexamined Patent Application Publication No. 2001-168982

PTL 5: Japanese Unexamined Patent Application Publication No. 2005-136907

SUMMARY OF INVENTION

Technical Problem

However, the proposed antenna devices using a power supply cord may not be able to receive broadcast waves with a sufficiently wide frequency band and sufficient gain.

Also, the sensitivity of the proposed antenna devices using a power supply cord changes in the case of bundling wire materials, and accordingly, in the case of using such an antenna device, a troublesome operation of unbundling the wire materials to obtain excellent reception sensitivity may be incurred.

Accordingly, in the case of including this antenna device, e.g., a PND, on a vehicle, the user has no other choice but to use a glass antenna on which a front glass is adhered, to obtain excellent reception sensitivity, given the current situation.

However, it is difficult for a common user to easily apply glass antennas, so convenience is poor.

The present invention provides an antenna device which can receive broadcast waves with a sufficiently wide frequency band and sufficient gain just by connecting wire material even if used bundled, without complicated efforts, and can obtain suitable reception sensitivity.

Solution to Problem

An antenna device includes a power supply cord which can transmit power, a connecting portion, a high-frequency signal cable for extracting a high-frequency signal from the connecting portion, and a high-frequency blocking portion disposed in two places in the length direction of the power supply cord, and with the power supply cord, a portion between the two high-frequency blocking portions is connected to the connecting portion to form an antenna, and the high-frequency signal cable is connected to the power supply cord via the connecting portion.

Advantageous Effects of Invention

According to the present invention, broadcast waves can be received with a sufficiently wide frequency band and sufficient gain just by connecting wire material even if used bundled, without complicated efforts, and suitable reception sensitivity can be obtained.

DESCRIPTION OF EMBODIMENTS

Description will be made below by correlating embodiments of the present invention with drawings.

Note that description will be made in accordance with the following sequence.

1. First Embodiment (First Configuration Example of Antenna Device)
2. Second Embodiment (Second Configuration Example of Antenna Device)
3. Third Embodiment (Third Configuration Example of Antenna Device)
4. Fourth Embodiment (Fourth Configuration Example of Antenna Device)
5. Fifth Embodiment (Fifth Configuration Example of Antenna Device)
6. Sixth Embodiment (Sixth Configuration Example of Antenna Device)
7. Seventh Embodiment (Seventh Configuration Example of Antenna Device)
8. Eighth Embodiment (Eighth Configuration Example of Antenna Device)

An antenna device which can be applied to an electronic device such as an onboard PND or the like will be described below as an example.

Entire Configuration of Antenna Device

Figure 1:
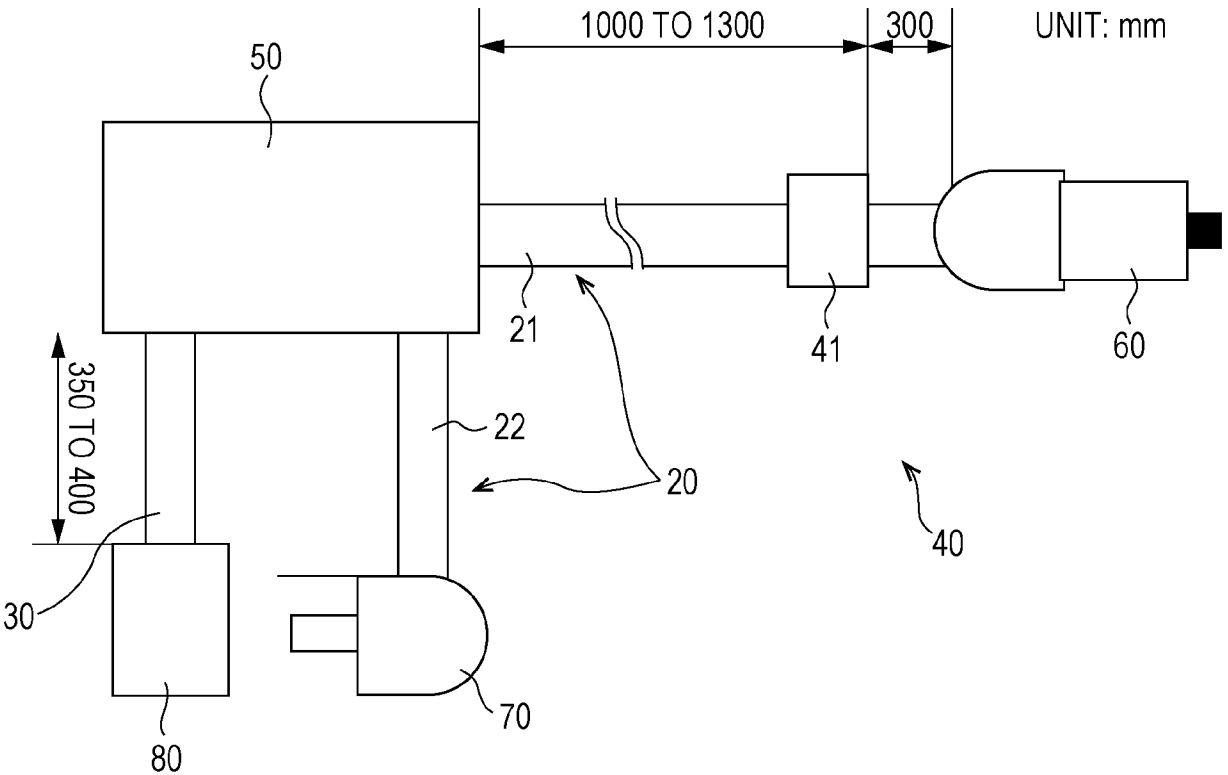
FIG. 1 is a diagram illustrating the entire configuration of an antenna device according to first through third embodiments of the present invention.

FIG. 1 is a diagram illustrating the entire configuration of an antenna device according an embodiment of the present invention.

With an antenna device 10 according to the present embodiment, two high-frequency blocking portions are disposed in a portion of an electric wire for power transmission or an electric wire in parallel therewith.

The antenna device 10 is formed as a power supply cable antenna wherein a high-frequency signal is superimposed, a power supply cable between high-frequency blocking portions thereof is taken as an antenna, and an electric wire and a high-frequency signal line can separately be input to an electronic device.

The antenna device 10 is formed as a power supply cable antenna for two-frequency common use which is made up of an antenna that another board forms connected to one of the high-frequency blocking portions via a filter, and an antenna made up of the other high-frequency blocking portion different from the above.

The antenna device 10 is formed as a power supply cable antenna whereby, at the time of connection from an electric wire to a high-frequency power supply circuit portion, a high-frequency current can be blocked by a high-frequency blocking portion, for example, by attaching ferrite beads, an inductor, and a ferrite core.

The antenna device 10 according to the present embodiment includes a power supply cord 20 serving as a power transmission cable formed of a coaxial wire or parallel two wires, a high-frequency signal cable (high-frequency signal line) 30, a ferrite core 41 serving as a high-frequency blocking portion 40, and a mold portion 50 serving as a connecting portion.

Also, with the antenna device 10, a car plug 60 for connecting to an onboard power supply unit (power supply unit) is connected to one edge side of the power supply cord 20, and a power supply connector 70 for connecting to the power supply unit of an electronic device is connected to the other edge side.

Also, a high-frequency handling plug 80 which can be connected to an antenna connecting portion of an electronic device is connected to one edge portion of the high-frequency signal cable 30.

Note that, in FIG. 1, only one of the ferrites serving as two high-frequency blocking portions is shown in the drawing. The ferrite serving as the other high-frequency blocking portion is disposed within the mold portion 50.

The power supply cord 20 is split into a first power supply cord 21 to which the car plug 60 is connected at the mold portion 50, and a second power supply cord 22 to which the power supply connector 70 is connected.

The mold portion 50 has a configuration capable of fixing the shape.

The first power supply cord 21 and the second power supply cord 22 are basically disposed within the mold portion 50 so as to be generally orthogonal in an extended state as shown in FIG. 1.

Also, the second power supply cord 22 and the high-frequency signal cable 30 are disposed within the mold portion 50 so as to be in parallel.

A ferrite core 41 for high-frequency isolation is inserted into a point of 1 m through 1.3 m from the edge portion of the mold portion 50 in the middle of the first power supply cord 21 from the edge portion (right edge in the drawing) of the mold portion 50 to the car plug 60 to receive a VHF low band.

1. First Embodiment

Figure 2:
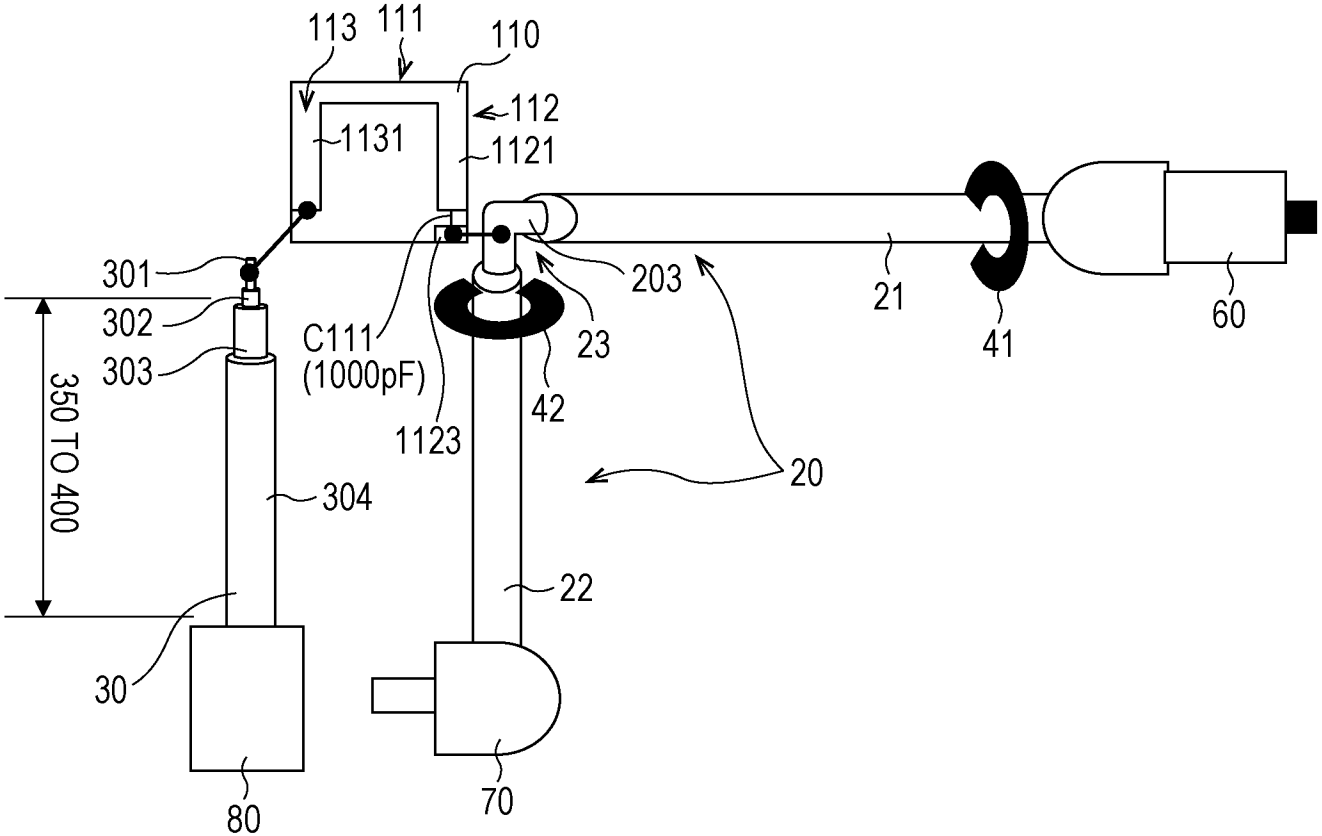
FIG. 2 is a diagram illustrating a specific configuration example of the antenna device according to the first embodiment of the present invention.

FIG. 2 is a diagram illustrating a specific configuration example of an antenna device according to the first embodiment of the present invention.

With the present first embodiment, a specific configuration within the mold portion 50 is shown.

Also, with the present first embodiment, a coaxial wire is applied as the power supply cord 20. A configuration example of this power supply cord 20 will be described.

Configuration Example of Power Supply Cord

Figure 3:
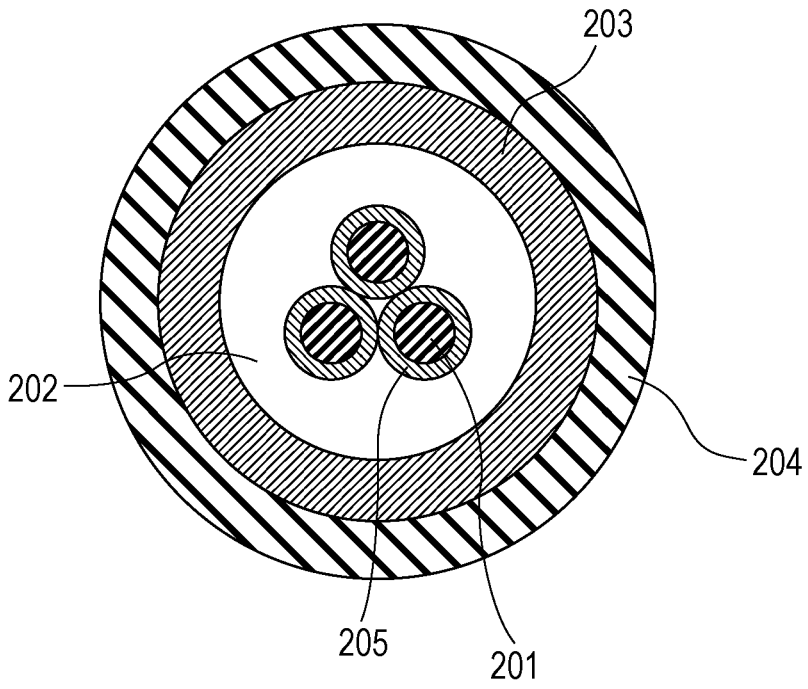
FIG. 3 is a diagram illustrating a configuration example of a coaxial cable with a shield portion.

FIG. 3 is a diagram illustrating a configuration example of a coaxial cable with a shield portion.

A coaxial cable 200 includes multiple core wires 201 and an internal insulator 202 for insulating the core wires 201.

The coaxial cable 200 includes a shield portion 203 disposed in the outer circumference of the internal insulator 202, and an external insulator (outer cover, jacket) 204 such as elastomer for covering the entire outer circumference, or the like.

With the core wires 201, the outer circumferences are covered and insulated by a flame resistance insulator 205. Also, the shield portion 203 is formed of an annealed copper wire, for example.

Also, the shield portion 203 is formed of multiple wires having electro-conductivity, e.g., a tactical grouped shield obtained by tactically grouping bare copper wires.

Note that, with the tactical grouped shield, occurrence of a shield gap is less even at the time of bending as compared to spiral shield, and this shield is known as an electrostatic shield method having suitable flexibility, bending strength, and mechanical strength.

The core wires 201 and the shield portion 203 have high-frequency impedance.

Note that the high-frequency signal cable 30 is formed of a coaxial cable (coaxial wire), and basically has the same configuration as the above-mentioned coaxial cable with a shield portion.

Specifically, the high-frequency signal cable 30 includes a core wire 301, and an internal insulator 302 for insulating the core wire 301.

The high-frequency signal cable 30 includes a shield portion 303 disposed in the outer circumference of the internal insulator 302, and an external insulator (outer cover, jacket) 304 such as elastomer for covering the entire outer circumference, or the like.

An antenna element 110 is disposed within the mold portion 50.

The antenna element 110 is formed as a pattern making up a generally U-letter shape.

Specifically, the antenna element 110 includes a base pattern portion 111.

With the antenna element 110, a first connection pattern portion 112 formed so as to extend orthogonal to the base pattern portion 111 is formed on one edge portion of the base pattern portion 111.

With the first connection pattern portion 112, a round pattern portion 1123 for connecting to the power supply cord 20 via a capacitor C111 is formed on the tip portion side of the extended pattern portion 1121.

The capacity of the capacitor C111 is set to 1000 pF, for example.

The round pattern portion 1123 is connected to the shield portion 203 of the portion of which the external insulator 204 of the power supply cord 20 has been removed.

With the antenna element 110, a second connection pattern portion 113 formed so as to extend orthogonal to the base pattern portion 111 is formed on the other edge portion of the base pattern portion 111.

The core wire 301 of the high-frequency signal cable 30 is connected to the second connection pattern portion 113.

The power supply cord 20 is, as described above, split into the first power supply cord 21 and the second power supply cord 22.

At the split portion 23 between the first power supply cord 21 and the second power supply cord 22, the external insulator 204 is removed.

Near the split portion 23 where the external insulator 204 of the second power supply cord 22 has been removed, i.e., at the edge portion on the opposite side of the connection edge of the power supply connector 70 of the second power supply cord 22, another ferrite core 42 serving as the high-frequency blocking portion 40, not shown in FIG. 1, is disposed.

In this way, with the antenna device 10 according to the present first embodiment, a coaxial wire is used as the power supply cord 20.

With the power supply cord 20, a ferrite core 41 is disposed (inserted) in the split first power supply cord 21, and a ferrite core 42 is disposed (inserted) in the second power supply cord 22.

The disposed position of the ferrite core 41 is adjusted with length of around 1 m through 1.3 m to shift resonance to the FM band that is the low band of VHF, as described above.

With the power supply cord 20, the external insulator 204 has been removed at the spilt portion 23 immediately before the ferrite core 42 disposed in the second power supply cord 22 between the ferrite cores 41 and 42 serving as the two high-frequency blocking portions 40.

The shield portion 203 of this split portion 23 is then connected to the round pattern portion 1123 on the antenna element 110 side, and an antenna is formed.

The antenna device 10 according to the present embodiment is configured so as to perform at least reception of FM that is an FM-VICS band.

The capacitor C111 is connected between the power supply cord 20 and the high-frequency signal cable as electrostatic countermeasures.

With the antenna feeding portion thus formed, the core wire 310 portion of the high-frequency signal cable 30 which is a coaxial wire is a portion connected to the second connection pattern portion 113 of the antenna element 110. The high-frequency signal cable 30 is then connected to the set (electronic device) via the high-frequency handling plug 80.

The antenna element 110 and the above connecting portions are stored in the mold portion 50.

Figure 4:
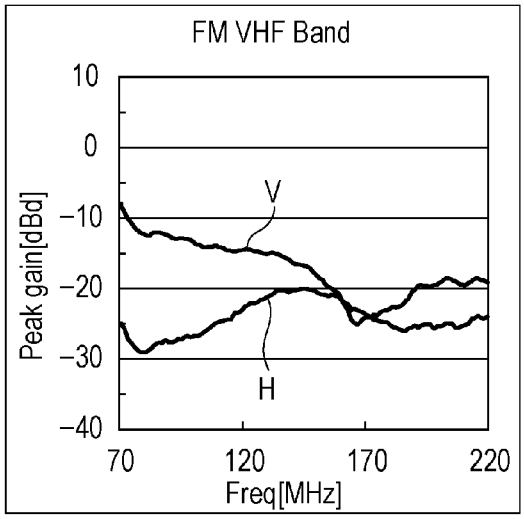
FIG. 4 is a diagram illustrating the peak gain property as to the frequency of a reception device in the event of employing the antenna device according to the present first embodiment.
Figure 4:
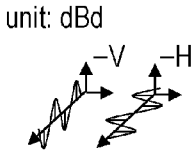

FIG. 4 is a diagram illustrating the peak gain property as to the frequency of the reception device in the event of employing the antenna device according to the first embodiment. FIG. 4 illustrates darkroom properties.

FIG. 4 illustrates the properties in the FM band and VHF band.

In FIG. 4, a curve indicated with H illustrates the property of horizontal polarization (Horizontal Polarization), and a curve indicated with V illustrates the property of vertical polarization (Vertical Polarization).

Also, FIG. 4 illustrates charts showing measurement results in detail in accordance with the property diagram.

As can be understood from the drawing, with darkroom properties, reception of FM that is an FM-VICS band can be performed without problems.

Figure 5:
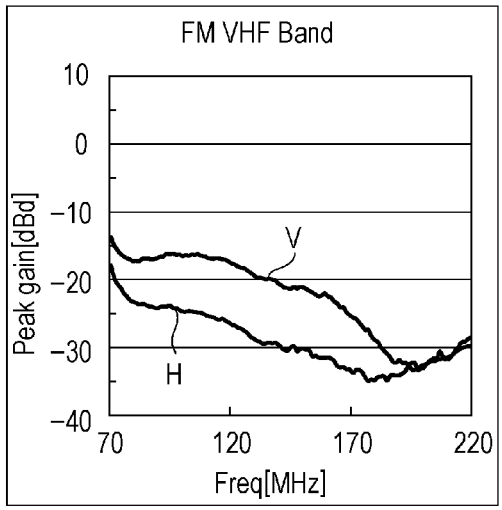
FIG. 5 is a diagram illustrating the peak gain property as to the frequency of a reception device in the event of employing a second power supply cord and a high-frequency signal cable bundled at the antenna device according to the present first embodiment.
Figure 5:
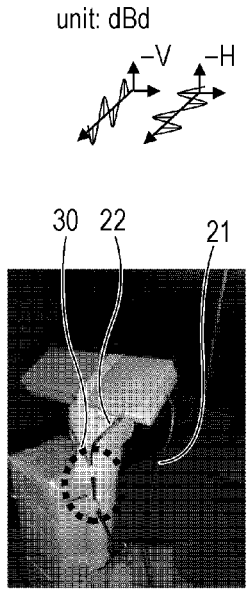

FIG. 5 is a diagram illustrating the peak gain property as to the frequency of the reception device in the case of employing the second power supply cord and the high-frequency signal cable bundled at the antenna device according to the present first embodiment.

Figure 6:
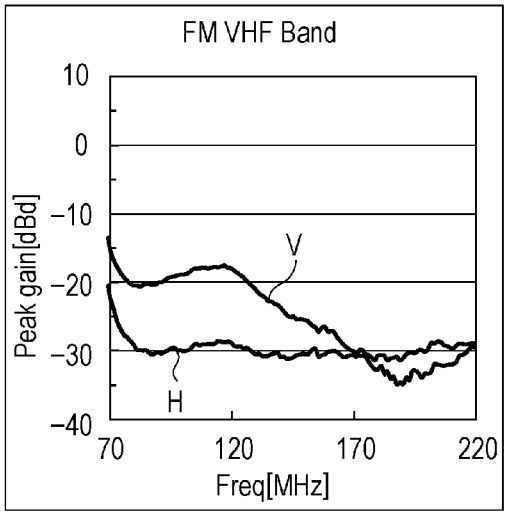
FIG. 6 is a diagram illustrating the peak gain property as to the frequency of a reception device in the event of employing the first power supply cord, the second power supply cord, and the high-frequency signal cable bundled at the antenna device according to the present first embodiment.
Figure 6:
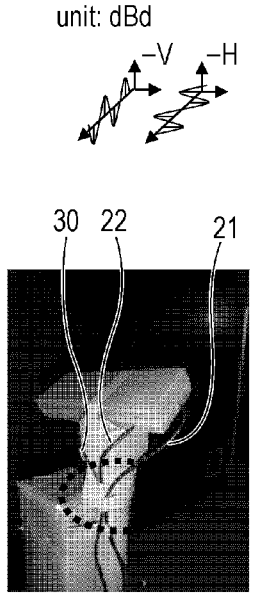

FIG. 6 is a diagram illustrating the peak gain property as to the frequency of the reception device in the case of employing the first power supply cord, the second power supply cord, and the high-frequency signal cable bundled at the antenna device according to the present first embodiment.

FIG. 5 and FIG. 6 illustrate darkroom properties.

FIG. 5 and FIG. 6 illustrate the properties in the FM and VHF bands.

In FIG. 5 and FIG. 6, a curve indicated with H illustrates the property of horizontal polarization (Horizontal Polarization), and a curve indicated with V illustrates the property of vertical polarization (Vertical Polarization).

Also, FIG. 5 and FIG. 6 illustrate charts showing measurement results in detail in accordance with the property diagram.

In a bundled state as well, as shown in FIG. 5 and FIG. 6, very excellent results have been obtained despite a slight deterioration.

That is to say, as can be understood from the drawings, even in a bundled state, with darkroom properties, reception of FM that is an FM-VICS band can be performed without problems.

2. Second Embodiment

Figure 7:
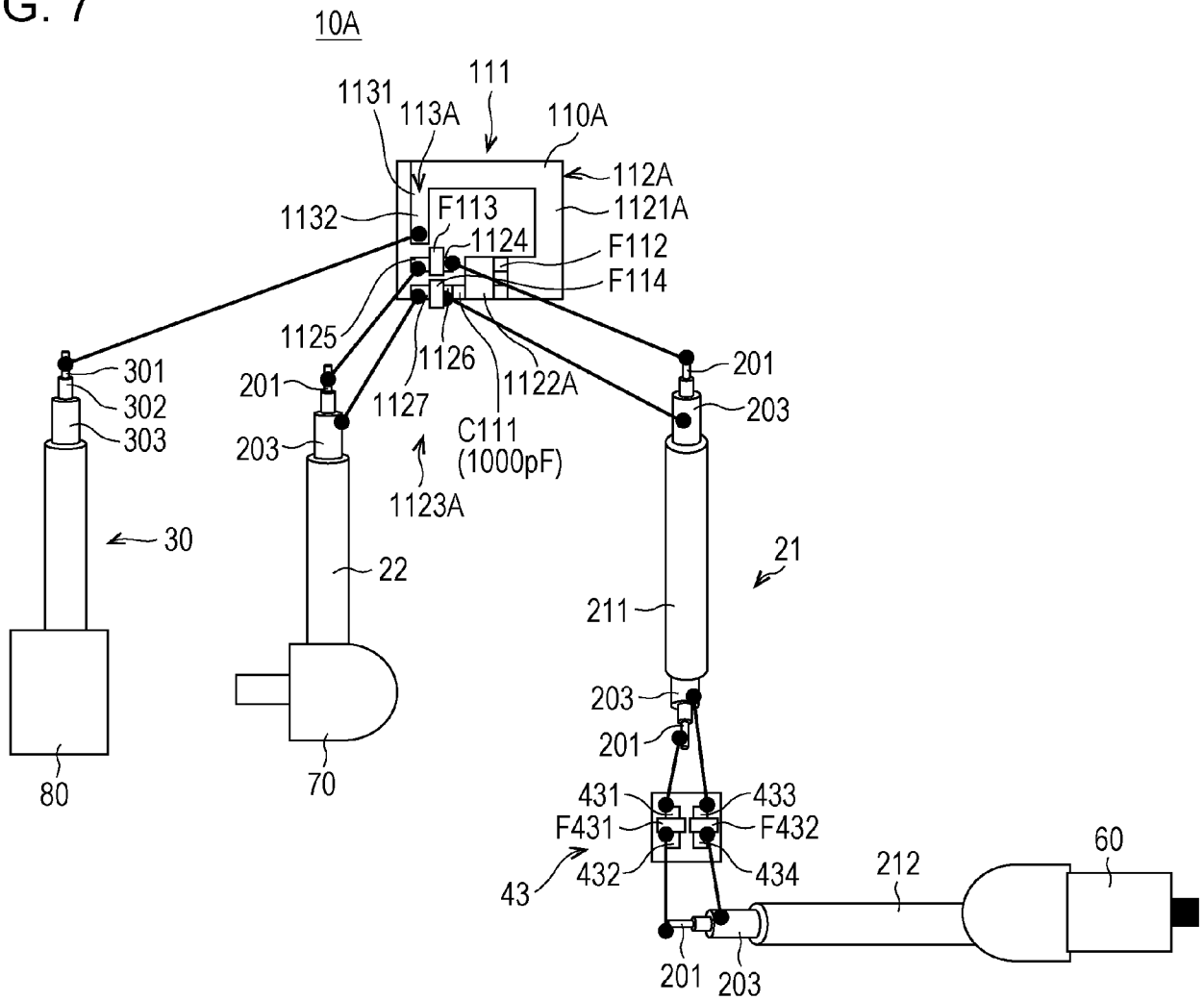
FIG. 7 is a diagram illustrating a specific configuration example of the antenna device according to the second embodiment of the present invention.

FIG. 7 is a diagram illustrating a specific configuration example of the antenna device according to the second embodiment of the present invention.

An antenna device 10A according to the present second embodiment differs from the antenna device 10 according to the first embodiment in that the high frequency blocking portions are replaced with chip components for high-frequency isolation instead of the ferrite cores.

Specifically, with the antenna device 10A, the first power supply cord 21 is split into two split power supply cord 211 and 212, and one edge of the split power supply cord 211, and one edge of the split power supply cord 212 are connected at a chip board 43 via a core wire and a shield portion.

This chip board 43 has the same function as the ferrite core 41 according to the first embodiment.

Also, the core wire and shield portion of the other edge of the split power supply cord 211 are connected to a first connection pattern portion 112A of an antenna element 110A.

The core wire and shield portion of an edge portion of the second power supply cord 22 are connected to a second round pattern portion 1123A of the antenna element 110A. The second round pattern portion 1123A of this antenna element 110A is converted into a chip board.

This second round pattern portion 1123A has the same function as the function of the ferrite core 42 according to the first embodiment.

With the chip board 43, round pattern portions 431, 432, 433, and 434 for connection are formed.

The round pattern portions 431 and 432 are connected via a filter F441.

The round pattern portions 433 and 434 are connected via a filter F442.

A core wire 201 of one edge portion of the split power supply cord 211 is connected to the round pattern portion 431, and a core wire 201 of an edge portion of the split power supply cord 212 is connected to the round pattern portion 432.

A shield portion 203 of one edge portion of the split power supply cord 211 is connected to the round pattern portion 433, and a shield portion 203 of an edge portion of the split power supply cord 212 is connected to the round pattern portion 434.

With the antenna element 110A, the extended pattern portion 1121A, first round pattern portion 1122A, and second round pattern portion 1123A of the first connection pattern portion 112A are extended to a base edge portion facing the base pattern portion 111.

Four round pattern portions 1124, 1125, 1126, and 1127 are formed as the second round pattern portion 1123A.

An edge portion of the extended pattern portion 1121A, and the first round pattern portion 1122A are connected via a filter F112.

The round pattern portion 1124 and round pattern portion 1125 are connected via a filter F113.

The round pattern portion 1126 and round pattern portion 1127 are connected via a filter F114.

Also, the first round pattern portion 1122A and round pattern portion 1126 are connected via the capacitor C111.

The core wire 201 of the other edge portion of the split power supply cord 211 is connected to the round pattern portion 1124, and the core wire 201 of an edge portion of the second power supply cord 22 is connected to the round pattern portion 1125.

The shield portion 203 of the other edge portion of the split power supply cord 211 is connected to the round pattern portion 1126, and the shield portion 203 of an edge portion of the second power supply cord 22 is connected to the round pattern portion 1127.

With the present second embodiment, the other configurations are the same as those in the first embodiment.

According to the present second embodiment, the same advantage as with the above-mentioned first embodiment can be obtained.

3. Third Embodiment

Figure 8:
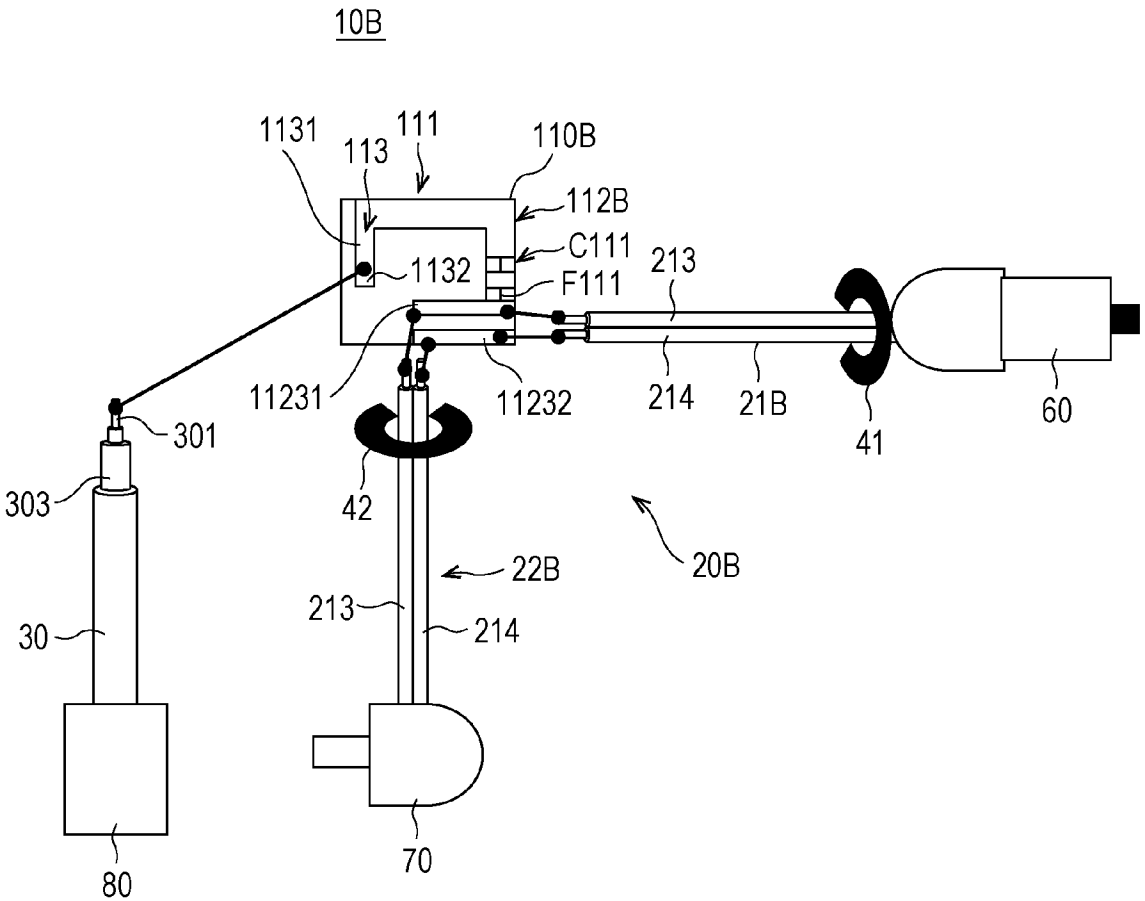
FIG. 8 is a diagram illustrating a specific configuration example of the antenna device according to the third embodiment of the present invention.

FIG. 8 is a diagram illustrating a specific configuration example of the antenna device according to the third embodiment of the present invention.

An antenna device 10B according to the present third embodiment differs from the antenna device 10 according to the first embodiment in that a cord made up of parallel two wires is used as a power supply cord 20B instead of a coaxial cable.

The power supply cord 20B includes two parallel wires 213 and 214.

With the antenna device 10B according to the third embodiment, two round pattern portions 1123 on the tip side of the first connection pattern portion 112B are formed so as to connect the two parallel wires 213 and 214 at the antenna element 110B.

Specifically, round pattern portions 11231 and 11232 are formed.

The parallel wire 213 of a first power supply cord 21B is connected to one edge portion of the round pattern portion 11231, and the parallel wire 214 of the first power supply cord 21B is connected to one edge portion of the round pattern portion 11232.

The parallel wire 213 of a second power supply cord 22B is connected to the other edge portion of the round pattern portion 11231, and the parallel wire 214 of the second power supply cord 22B is connected to the other edge portion of the round pattern portion 11232.

With the present third embodiment, the other configurations are the same as those in the first embodiment.

According to the present third embodiment, the same advantage as with the above-mentioned first embodiment can be obtained.

Entire Configuration of Antenna Device

Next, the fourth through seventh embodiments of the present invention will be described.

Figure 9:
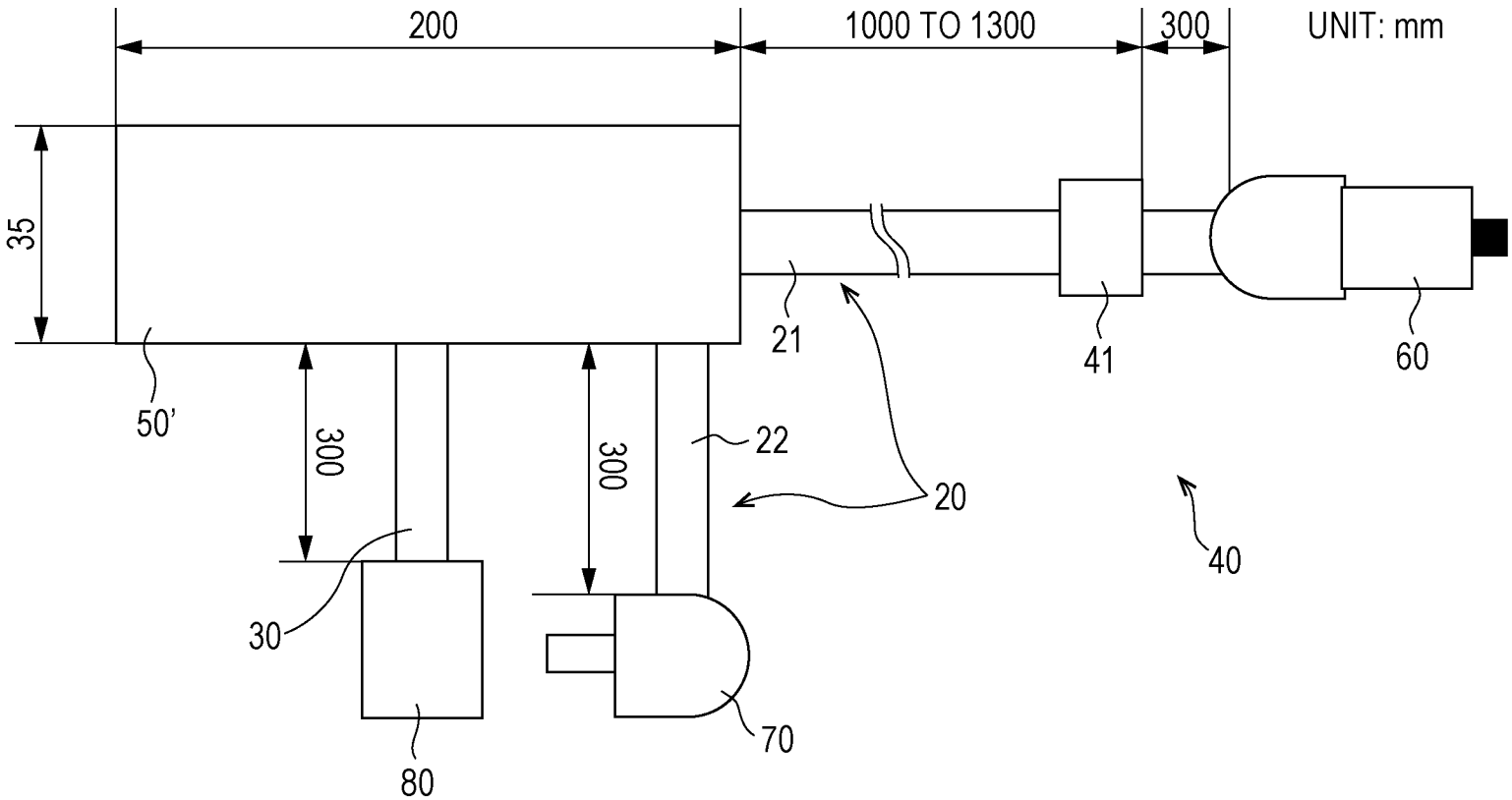
FIG. 9 is a diagram illustrating the entire configuration of an antenna device according to fourth through seventh embodiments of the present invention.

FIG. 9 is a diagram illustrating the entire configuration of an antenna device according to the fourth through seventh embodiments of the present invention.

With an antenna device 10C according to the present embodiment, two high-frequency blocking portions are disposed in a portion of an electric wire for power transmission or an electric wire provided in parallel therewith.

The antenna device 10C is formed as a power supply cable antenna wherein a high-frequency signal is superimposed, a power supply cable between high-frequency blocking portions thereof is taken as an antenna, and an electric wire and a high-frequency signal line can separately be input to an electronic device.

The antenna device 10C is formed as a power supply cable antenna for two-frequency common use which is made up of an antenna that another board forms connected to one of the high-frequency blocking portions via a filter, and an antenna made up of the other high-frequency blocking portion different from the above.

The antenna device 10C is formed as a power supply cable antenna whereby, at the time of connection from an electric wire to a high-frequency power supply circuit portion, a high-frequency current can be blocked by a high-frequency blocking portion, for example, by attaching ferrite beads, an inductor, and a ferrite core.

The antenna device 10C according to the present embodiment includes a power supply cord 20 serving as a power transmission cable formed of a coaxial wire or parallel two wires, a high-frequency signal cable (high-frequency signal line) 30, a ferrite core 41 serving as a high-frequency blocking portion 40, and a mold portion 50' including a relay connecting portion Also, with the antenna device 10C, a car plug 60 for connecting to an onboard power supply unit (power supply unit) is connected to one edge side of the power supply cord 20, and a power supply connector 70 for connecting to the power supply unit of an electronic device is connected to the other edge side.

Also, a high-frequency handling plug 80 which can be connected to an antenna connecting portion of an electronic device is connected to one edge portion of the high-frequency signal cable 30.

Note that, in FIG. 9, only one of the ferrites serving as two high-frequency blocking portions is shown in the drawing. The ferrite serving as the other high-frequency blocking portion is disposed within the mold portion 50'.

The power supply cord 20 is split into a first power supply cord 21 to which the car plug 60 is connected at the mold portion 50', and a second power supply cord 22 to which the power supply connector 70 is connected.

The mold portion 50' has a configuration so as to fix the shape.

The first power supply cord 21 and the second power supply cord 22 are disposed within the mold portion 50' so as to be generally orthogonal in a basically extended state as shown in FIG. 9.

Also, the second power supply cord 22 and the high-frequency signal cable 30 are disposed within the mold portion 50' so as to be in parallel.

The mold portion 50' has, for example, as shown in FIG. 9, a size of width 35 mm and length 200 mm.

A ferrite core 41 for high-frequency isolation is inserted into a point of 1 m through 1.3 m from the edge portion of the mold portion 50' in the middle of the first power supply cord 21 from the edge portion (right edge in the drawing) of the mold portion 50' to the car plug 60 to receive a VHF low (LOW) band.

4. Fourth Embodiment

Figure 10:
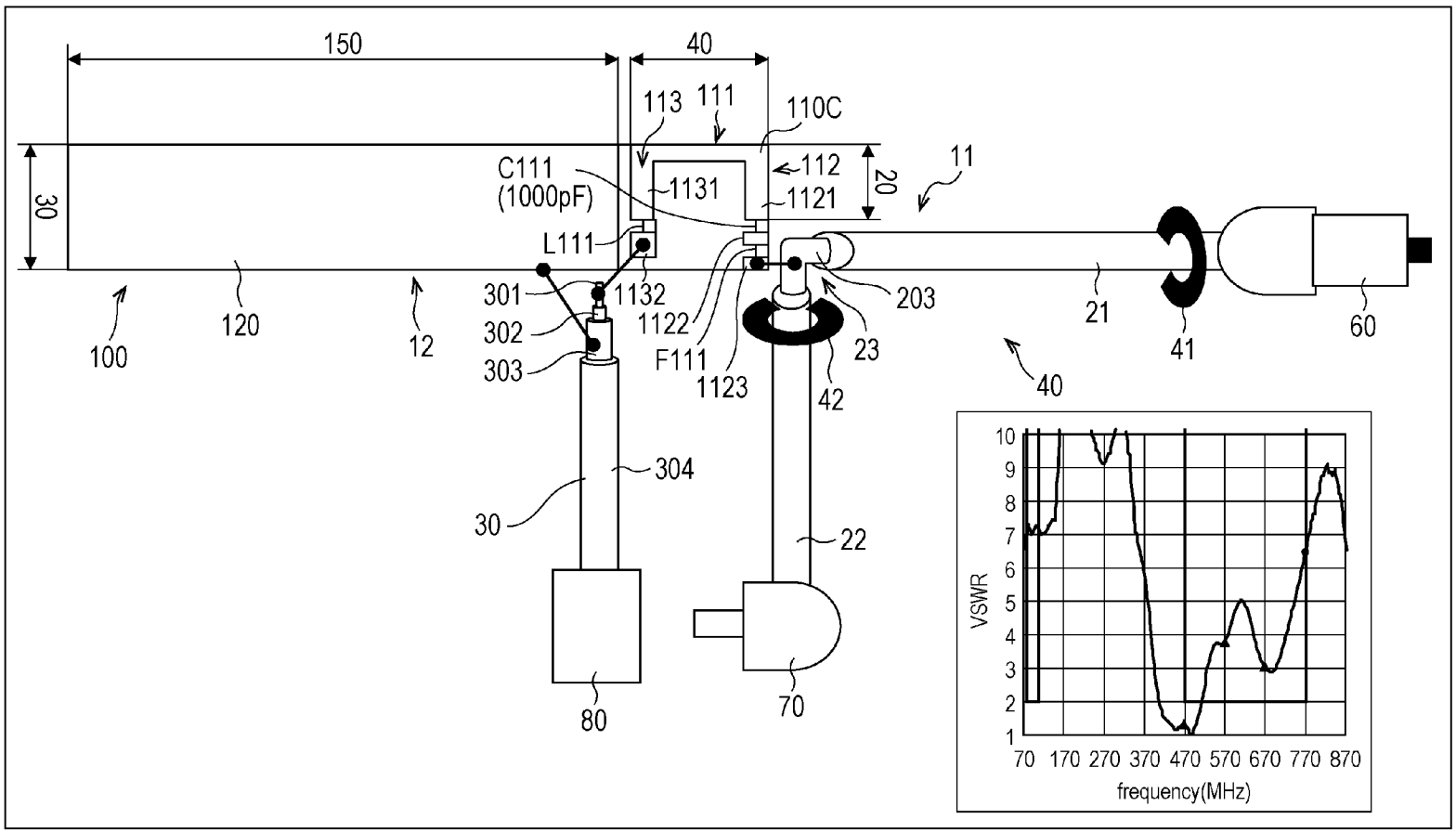
FIG. 10 is a diagram illustrating a specific configuration example of the antenna device according to the fourth embodiment of the present invention.

FIG. 10 is a diagram illustrating a specific configuration example of an antenna device according to the fourth embodiment of the present invention.

With the present fourth embodiment, a specific configuration within the mold portion 50' is shown.

Also, with the present fourth embodiment, a coaxial wire is applied as the power supply cord 20. A configuration example of this power supply cord 20 is the same as with the above-mentioned FIG. 3.

An antenna board portion 100 is disposed within the mold portion 50'.

With the antenna board portion 100, an antenna element (first antenna element) 110C, and antenna ground (second antenna element) 120 are formed so as to be in parallel.

The antenna element 110C is formed as a pattern making up a generally U-letter shape.

Specifically, the antenna element 110C includes a base pattern portion 111.

The length of the base pattern portion 111 is set to 40 mm, for example.

With the antenna element 110C, a first connection pattern portion 112 formed so as to extend orthogonal to the base pattern portion 111 is formed on one edge portion of the base pattern portion 111.

With the first connection pattern portion 112, a first round pattern portion 1122 is formed via a capacitor C111 on the tip portion side of the extended pattern portion 1121 thereof. A second round pattern portion 1123 for connecting to the power supply cord 20 via the filter F111 is formed as to the first round pattern portion 1122. The capacity of the capacitor C111 is set to 1000 pF, for example.

The second round pattern portion 1123 is connected to the shield portion 203 of the portion of which the external insulator 204 of the power supply cord 20 has been removed.

Note that the length of the extended pattern portion 1121 is set to 20 mm, for example.

With the antenna element 110C, a second connection pattern portion 113 formed so as to extend orthogonal to the base pattern portion 111 is formed on the other edge portion of the base pattern portion 111.

With the second connection pattern portion 113, a round pattern portion 1132 is formed via a matching element, e.g., an inductor L111 on the tip portion side of the extended pattern portion 1131. The inductance of the inductor L111 is set to 40 nH, for example.

The core wire 301 of the high-frequency signal cable 30 is connected to the round pattern portion 1132.

The antenna ground 120 is formed in a tabular shape so as to be in parallel with the antenna element 110C (left side in FIG. 10).

The antenna ground 120 is formed with a size of width 30 mm and length 150 mm, for example.

The power supply cord 20 is, as described above, split into the first power supply cord 21 and the second power supply cord 22.

At the split portion 23 between the first power supply cord 21 and the second power supply cord 22, the external insulator 204 is removed.

Near the split portion 23 where the external insulator 204 of the second power supply cord 22 has been removed, i.e., at the edge portion on the opposite side of the connection edge of the power supply connector 70 of the second power supply cord 22, another ferrite core 42 serving as the high-frequency blocking portion 40, not shown in FIG. 9, is disposed.

In this way, with the antenna device 10C according to the present fourth embodiment, a coaxial wire is used as the power supply cord 20.

With the power supply cord 20, a ferrite core 41 is disposed (inserted) in the split first power supply cord 21, and a ferrite core 42 is disposed (inserted) in the second power supply cord 22.

The disposed position of the ferrite core 41 is adjusted with length of around 1 m through 1.3 m to shift resonance to the FM band that is the LOW band of VHF, as described above, so as to resonate with a lower frequency than the antenna made up of the antenna board portion 100.

With the power supply cord 20, the external insulator 204 has been removed at the spilt portion 23 immediately before the ferrite core 42 disposed in the second power supply cord 22 between the ferrite cores 41 and 42 serving as the two high-frequency blocking portions 40.

The shield portion 203 of this split portion 23 is then connected to the second round pattern portion 1123 on the antenna element 110C side, and a first antenna is formed.

Also, a second antenna 12 made up of the antenna board portion 100 is formed of an antenna device 110C and antenna ground 120.

The antenna device 10C according to the present embodiment is configured so as to receive digital television broadcast waves broadcasted with the UHF band.

Originally, with a dipole antenna, 30 cm with 15 cm each side is required, but the size of the mold portion 50 increases.

Therefore, with the present fourth embodiment, an arrangement is employed wherein the antenna ground 120 is secured, the antenna element 110C is shortened, and input impedance is adjusted at the inductor L111 which is a matching element.

In this case, with the inductor L111, inductance is 47 nH, but high antenna performance is maintained without deteriorating antenna gain by increasing antenna radiation at the antenna ground 120.

The second antenna 12 and first antenna 11 are connected via the filter F111 which exhibits low impedance with the VHF band, and exhibits high impedance with the UHF band so as to separate the first antenna 11 and second antenna 12.

Moreover, as electrostatic countermeasures, with the VHF and UHF bands, the first antenna 11 and second antenna 12 are corrected via the capacitor C111 which exhibits low impedance.

The power feeding portion of the second antenna 12 is a portion where the antenna ground 120 is connected to the shield portion 303 of the high-frequency signal cable 30 which is a coaxial wire, and the core wire 301 portion of the coaxial wire is connected to the round pattern portion 1132 of the antenna element 110C.

The high-frequency signal cable 30 is connected to the set (electronic device) via the high-frequency handling plug 80.

The antenna board portion 100 and the above-mentioned connecting portions are stored in the mold portion 50'.

Figure 11:
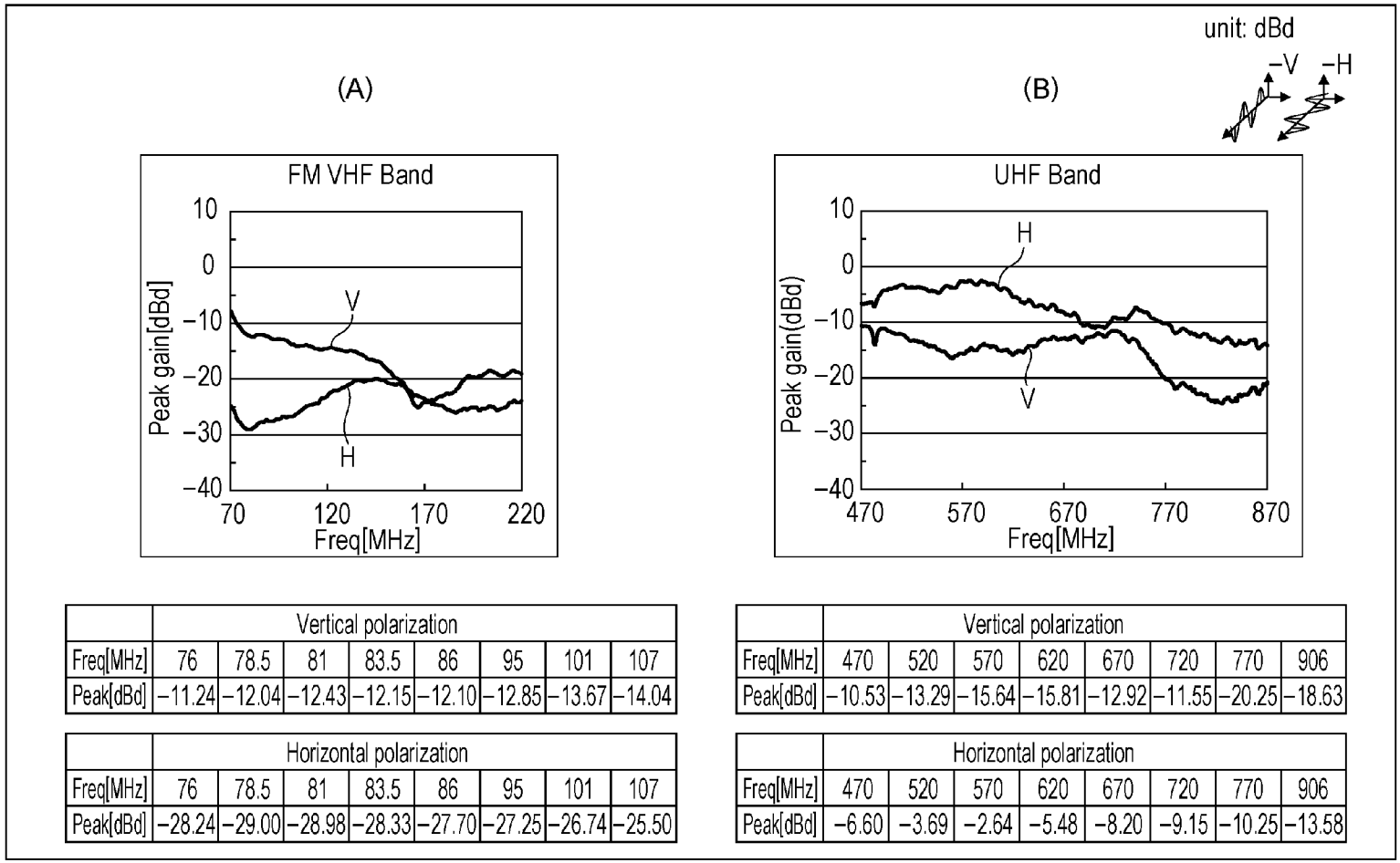
FIG. 11 is a diagram illustrating the peak gain property as to the frequency of a reception device in the event of employing the antenna device according to the present fourth embodiment.

(A) and (B) in FIG. 11 are diagrams illustrating the peak gain property as to the frequency of the reception device in the event of employing the antenna device according to the present fourth embodiment. (A) and (B) in FIG. 11 illustrate darkroom properties.

(A) in FIG. 11 illustrates the properties in the FM and VHF bands, and (B) in FIG. 11 illustrates the property in the UHF band.

With (A) and (B) in FIG. 11, a curve indicated with H illustrates the property of horizontal polarization (Horizontal Polarization), and a curve indicated with V illustrates the property of vertical polarization (Vertical Polarization).

Also, (A) and (B) in FIG. 11 illustrate charts showing measurement results in detail in accordance with the property diagram.

As can be understood from the drawings, with darkroom properties, reception of FM that is an FM-VICS band, and reception of the UHF band for receiving a digital television broadcast can be performed without problems.

Figure 12:
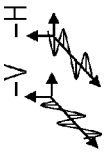
FIG. 12 is a diagram illustrating the peak gain property as to the frequency of a reception device in the event of employing a second power supply cord and a high-frequency signal cable bundled at the antenna device according to the present fourth embodiment.
Figure 12:
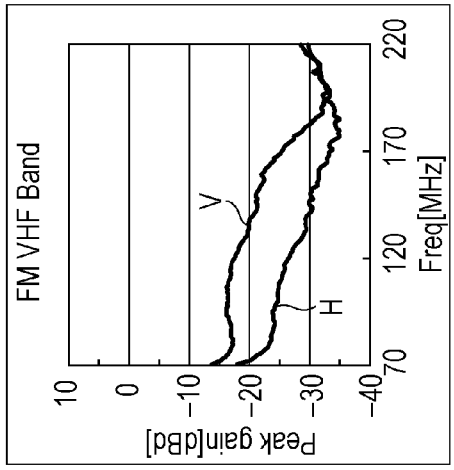
Figure 12:
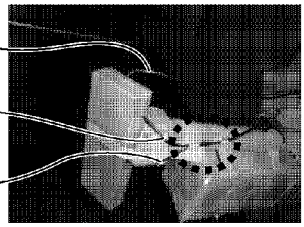
Figure 12:
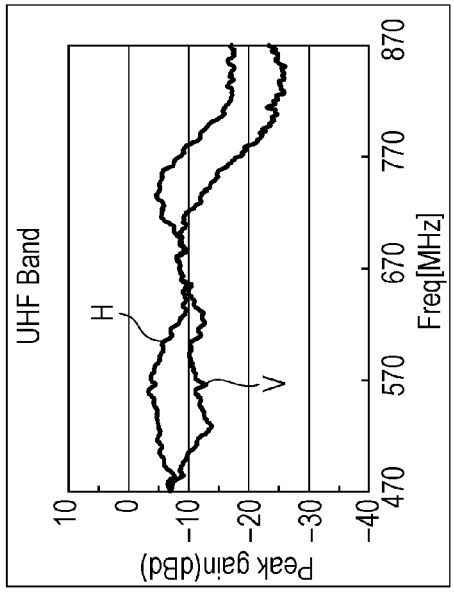

(A) and (B) in FIG. 12 are diagrams illustrating the peak gain property as to the frequency of the reception device in the event of employing the second power supply cord and the high-frequency signal cable bundled at the antenna device according to the present fourth embodiment.

Figure 13:
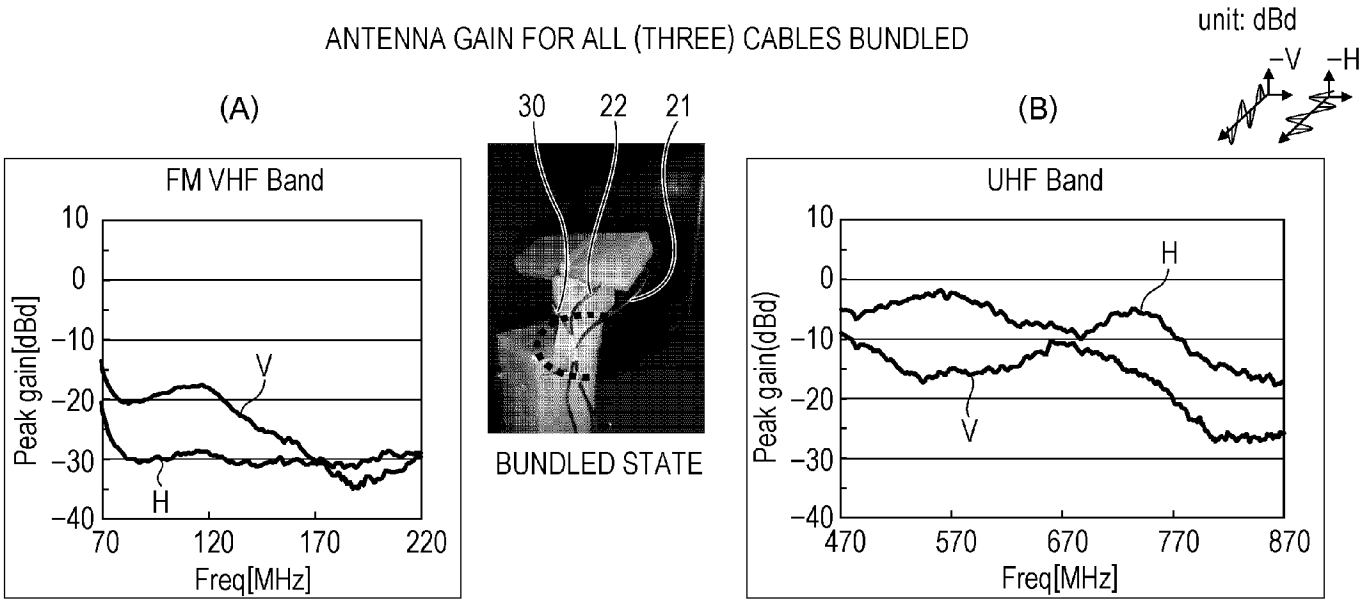
FIG. 13 is a diagram illustrating the peak gain property as to the frequency of a reception device in the event of employing the first power supply cord, the second power supply cord, and the high-frequency signal cable bundled at the antenna device according to the present fourth embodiment.

(A) and (B) in FIG. 13 are diagrams illustrating the peak gain property as to the frequency of the reception device in the event of employing the first power supply cord, second power supply cord, and high-frequency signal cable bundled at the antenna device according to the present fourth embodiment.

(A) and (B) in FIG. 12 and FIG. 13 illustrate darkroom properties.

(A) in FIG. 12 and FIG. 13 illustrate the properties in the FM and VHF bands, and (B) in FIG. 12 and FIG. 13 illustrate the property in the UHF band.

With (A) and (B) in FIG. 12 and FIG. 13, a curve indicated with H illustrates the property of horizontal polarization (Horizontal Polarization), and a curve indicated with V illustrates the property of vertical polarization (Vertical Polarization).

Also, (A) and (B) in FIG. 12 and FIG. 13 illustrate charts showing measurement results in detail in accordance with the property diagram.

In a bundled state as well, as shown in FIG. 12 and FIG. 13, very excellent results have been obtained despite a slight deterioration.

That is to say, as can be understood from the drawings, even in a bundled state as well, with darkroom properties, reception of FM that is an FM-VICS band, and reception of the UHF band for receiving a digital television broadcast can be performed without problems.

5. Fifth Embodiment

Figure 14:
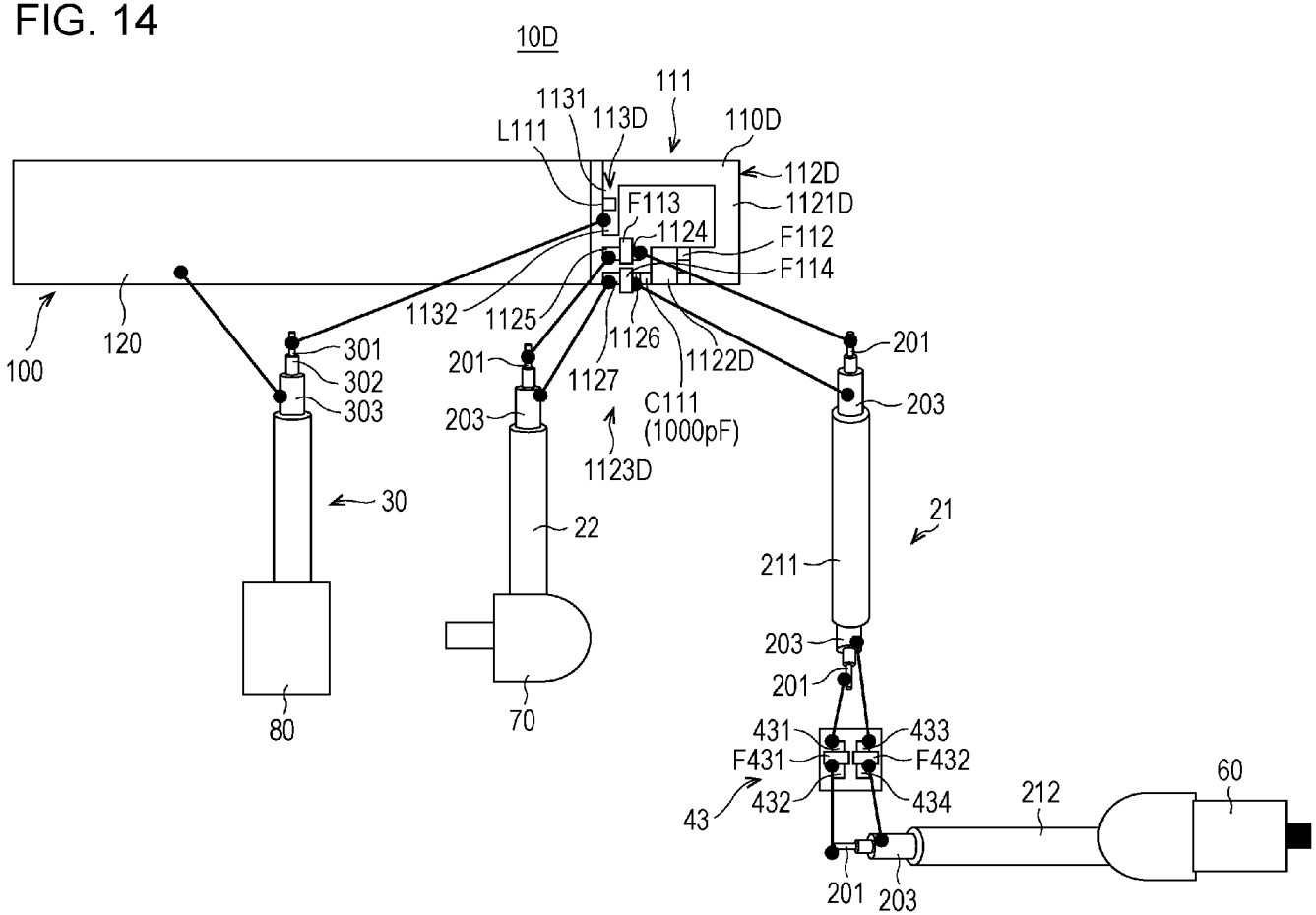
FIG. 14 is a diagram illustrating a specific configuration example of the antenna device according to the fifth embodiment of the present invention.

FIG. 14 is a diagram illustrating a specific configuration example of the antenna device according to the fifth embodiment of the present invention.

An antenna device 10D according to the present fifth embodiment differs from the antenna device 10C according to the fourth embodiment in that the high frequency blocking portions are replaced with chip components for high-frequency isolation instead of the ferrite cores.

Specifically, with the antenna device 10D, the first power supply cord 21 is split into two split power supply cord 211 and 212, and one edge of the split power supply cord 211, and one edge of the split power supply cord 212 are connected at the chip board 43 via a core wire and a shield portion.

This chip board 43 has the same function as the ferrite core 41 according to the fourth embodiment.

Also, the core wire and shield portion of the other edge of the split power supply cord 211 are connected to a first connection pattern portion 112D of an antenna element 110D of an antenna board portion 100D.

The core wire and shield portion of an edge portion of the second power supply cord 22 are connected to a second round pattern portion 1123D of the antenna element 110D.

The second round pattern portion 1123D of this antenna element 110D is converted into a chip board.

This second round pattern portion 1123D has the same function as the function of the ferrite core 42 according to the fourth embodiment.

With the chip board 43, round pattern portions 431, 432, 433, and 434 for connection are formed.

The round pattern portions 431 and 432 are connected via a filter F431.

The round pattern portions 433 and 434 are connected via a filter F432.

A core wire 201 of one edge portion of the split power supply cord 211 is connected to the round pattern portion 431, and a core wire 201 of an edge portion of the split power supply cord 212 is connected to the round pattern portion 432.

A shield portion 203 of one edge portion of the split power supply cord 211 is connected to the round pattern portion 433, and a shield portion 203 of an edge portion of the split power supply cord 212 is connected to the round pattern portion 434.

With the antenna element 110D, the extended pattern portion 1121D, first round pattern portion 1122D, and second round pattern portion 1123D of the first connection pattern portion 112D are extended to a base edge portion facing the base pattern portion 111.

Four round pattern portions 1124, 1125, 1126, and 1127 are formed as the second round pattern portion 1123D.

An edge portion of the extended pattern portion 1121D, and the first round pattern portion 1122D are connected via the filter F112.

The round pattern portion 1124 and round pattern portion 1125 are connected via the filter F113.

The round pattern portion 1126 and round pattern portion 1127 are connected via the filter F114.

Also, the first round pattern portion 1122D and round pattern portion 1126 are connected via the capacitor C111.

The core wire 201 of the other edge portion of the split power supply cord 211 is connected to the round pattern portion 1124, and the core wire 201 of an edge portion of the second power supply cord 22 is connected to the round pattern portion 1125.

The shield portion 203 of the other edge portion of the split power supply cord 211 is connected to the round pattern portion 1126, and the shield portion 203 of an edge portion of the second power supply cord 22 is connected to the round pattern portion 1127.

With the present fifth embodiment, the other configurations are the same as those in the fourth embodiment.

According to the present fifth embodiment, the same advantage as with the above-mentioned fourth embodiment can be obtained.

6. Sixth Embodiment

Figure 15:
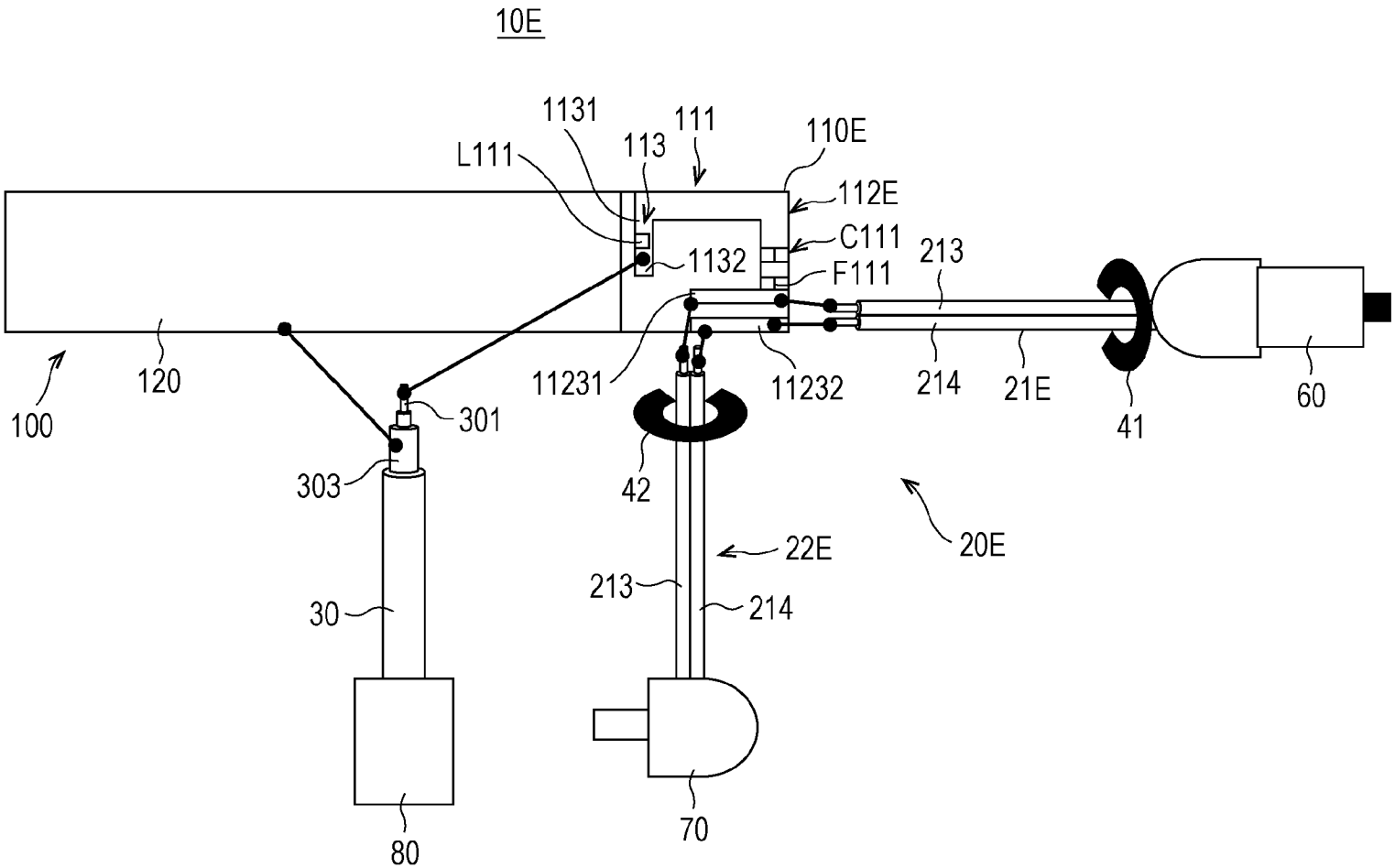
FIG. 15 is a diagram illustrating a specific configuration example of the antenna device according to the sixth embodiment of the present invention.

FIG. 15 is a diagram illustrating a specific configuration example of the antenna device according to the sixth embodiment of the present invention.

An antenna device 10E according to the present sixth embodiment differs from the antenna device 10C according to the fourth embodiment in that a cord made up of parallel two wires is used as a power supply cord 20E instead of a coaxial cable.

The power supply cord 20E includes two parallel wires 213 and 214.

With the antenna device 10E according to the sixth embodiment, two round pattern portions 1123 on the tip side of the first connection pattern portion 112E are formed so as to connect the two parallel wires 213 and 214 at the antenna element 110E.

Specifically, round pattern portions 11231 and 11232 are formed.

The parallel wire 213 of a first power supply cord 21E is connected to one edge portion of the round pattern portion 11231, and the parallel wire 214 of the first power supply cord 21E is connected to one edge portion of the round pattern portion 11232.

The parallel wire 213 of a second power supply cord 22E is connected to the other edge portion of the round pattern portion 11231, and the parallel wire 214 of the second power supply cord 22E is connected to the other edge portion of the round pattern portion 11232.

With the present sixth embodiment, the other configurations are the same as those in the fourth embodiment.

According to the present sixth embodiment, the same advantage as with the above-mentioned fourth embodiment can be obtained.

7. Seventh Embodiment

Figure 16:
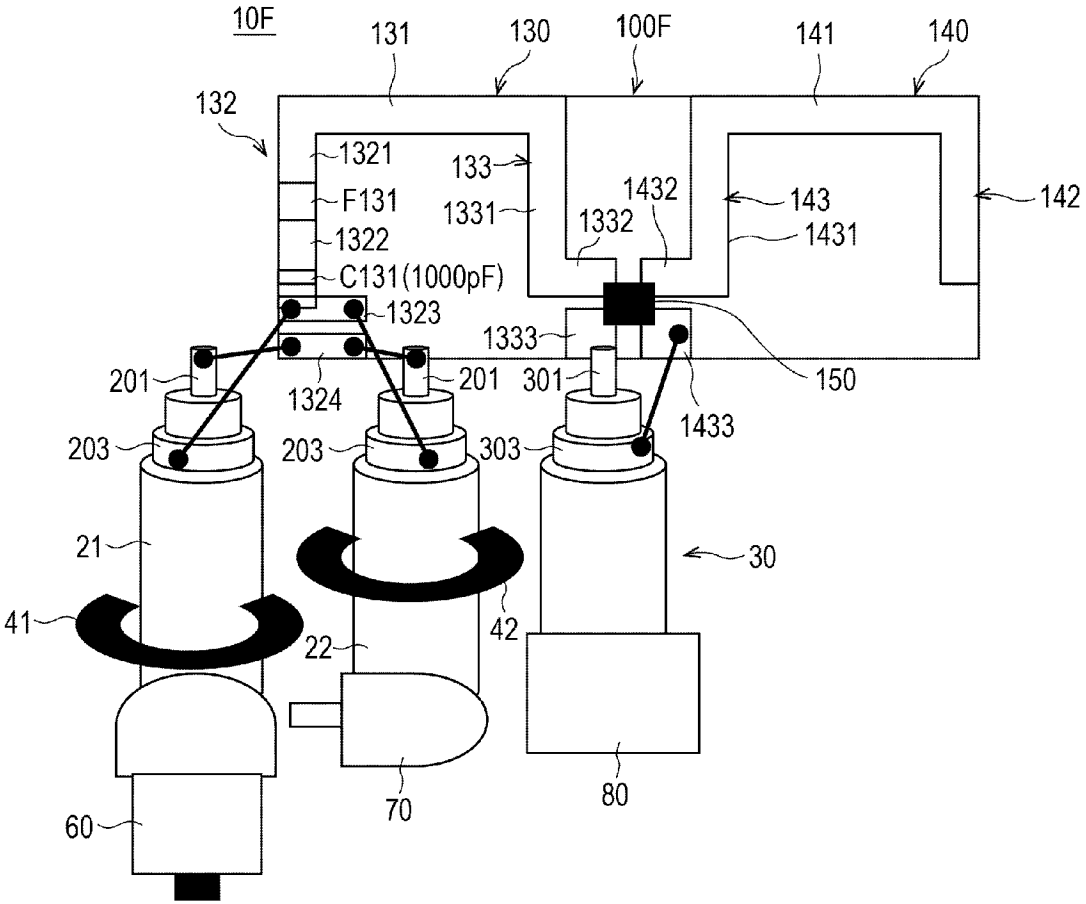
FIG. 16 is a diagram illustrating a specific configuration example of the antenna device according to the seventh embodiment of the present invention.

FIG. 16 is a diagram illustrating a specific configuration example of the antenna device according to the seventh embodiment of the present invention.

An antenna device 10F according to the present seventh embodiment differs from the antenna device 10C according to the fourth embodiment in that this antenna device is formed as a dipole antenna at an antenna board portion 100F.

With the antenna device 10F, a first antenna element 130 and a second antenna element 140 are formed on the antenna board portion 100F.

Note that it is desirable to set the lengths of the first antenna element 130 and second antenna element 140 to 30 cm with 15 cm each side.

With the first antenna element 130, a first connection pattern portion 132 formed so as to extend orthogonal to the base pattern portion 131 is formed on one edge portion of the base pattern portion 131.

With the first connection pattern portion 132, a first round pattern portion 1322 is formed via a filter F131 on the tip portion side of the extended pattern portion 1321 thereof.

Two second round pattern portions 1323 and 1324 for connecting to the power supply cord 20 via a capacitor C131 are formed as to the first round pattern portion 1322. The capacity of the capacitor C131 is set to 1000 pF, for example.

The second round pattern portion 1323 is connected to the shield portion 203 of the portion of which the external insulator 204 of the power supply cord 20 has been removed.

With the first antenna element 130, a second connection pattern portion 133 formed so as to extend orthogonal to the base pattern portion 131 is formed on one edge portion of the base pattern portion 131.

With the second connection pattern portion 133, a bent pattern portion 1332 extended bent toward the second antenna element 140 side is formed on the tip portion side of the extended pattern portion 1331.

Also, with the second connection pattern portion 133, a round pattern portion 1333 is formed facing the bent pattern portion 1332.

With the second antenna element 140, a third connection pattern portion 142 formed so as to extend orthogonal to the base pattern portion 141 is formed on one edge portion of the base pattern portion 141.

With the second antenna element 140, a fourth connection pattern portion 143 formed so as to extend orthogonal to the base pattern portion 141 is formed on the other edge portion of the base pattern portion 141.

With the fourth connection pattern portion 143, a bent pattern portion 1432 extended bent on the first antenna element 130 side is formed on the tip portion of the extended pattern portion 1431.

Also, with the fourth connection pattern portion 143, a round pattern portion 1433 is formed facing the bent pattern portion 1432.

The shield portion 203 of the first power supply cord 21 is connected to one edge portion of the second round pattern portion 1323 of the first antenna element 130, and the core wire 201 of the first power supply cord 21 is connected to one edge portion of the second round pattern portion 1324.

The shield portion 203 of the second power supply cord 22 is connected to the other edge portion of the second round pattern portion 1323 of the first antenna element 130, and the core wire 201 of the second power supply cord 22 is connected to the other edge portion of the second round pattern portion 1324.

The core wire 301 of the high-frequency signal cable 30 is connected to the round pattern portion 1333.

Also, the shield portion 303 of the high-frequency signal cable 30 is connected to the round pattern portion 1433.

The bend pattern portion 1332 and round pattern portion 1333 of the second connection pattern portion 133, and the bent pattern portion 1432 and round pattern portion 1433 of the fourth connection pattern portion 143 are connected to a balanced-to-unbalanced transformer (balun) 150.

Figure 17:
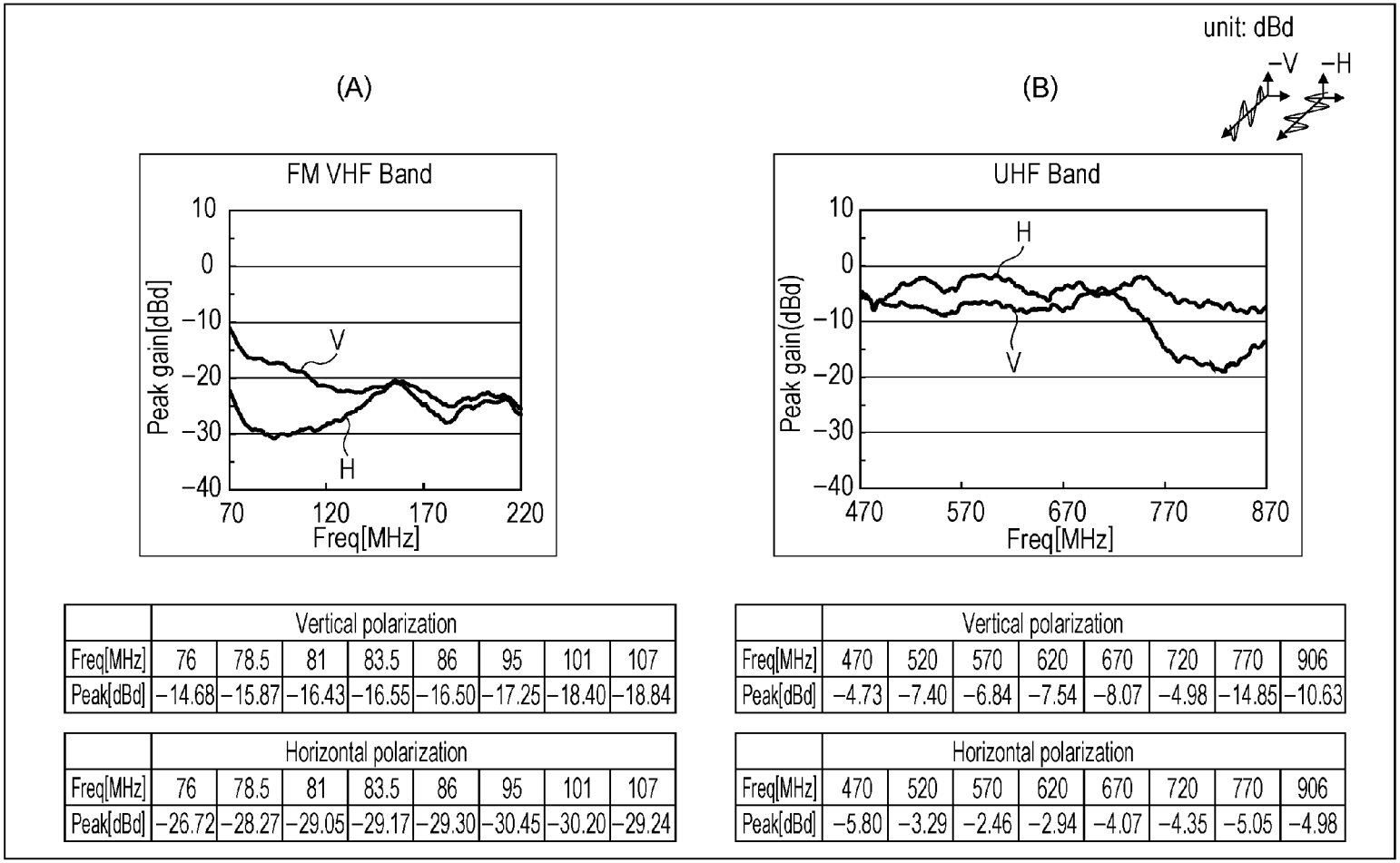
FIG. 17 is a diagram illustrating the peak gain property as to the frequency of a reception device in the event of employing the antenna device according to the present seventh embodiment.

(A) and (B) in FIG. 17 are diagrams illustrating the peak gain property as to the frequency of the reception device in the event of employing the antenna device according to the present seventh embodiment.

(A) in FIG. 17 illustrates the properties in the FM and VHF bands, and (B) in FIG. 17 illustrates the property in the UHF band.

With (A) and (B) in FIG. 17, a curve indicated with H illustrates the property of horizontal polarization (Horizontal Polarization), and a curve indicated with V illustrates the property of vertical polarization (Vertical Polarization).

Also, (A) and (B) in FIG. 17 illustrate charts showing measurement results in detail in accordance with the property diagram.

As can be understood from the drawings, with darkroom properties, reception of FM that is an FM-VICS band, and reception of the UHF band for receiving a digital television broadcast can be performed without problems.

8. Eighth Embodiment

The antenna device according to the eighth embodiment of the present invention directly connects the shield portion 203 of the power supply cord 20, and the core wire 301 of the high-frequency signal cable 30 at the antenna board portion 100 of the connecting portion though not shown in the drawing.

Note that, in this case, it is desirable to connect the shield portion 203 of the power supply cord 20, and the core wire 301 of the high-frequency signal cable 30 via a capacitor.

In this case as well, reception of FM that is an FM-VICS band, and reception of the UHF band for receiving a digital television broadcast can be performed without problems.

Note that, with the present embodiment, though a vehicle has been described as an example of a use environment, if the car plug is replaced with a common home outlet for example, a device for home use can also be used without problems.

As described above, according to the present embodiment, broadcast waves can be received with a sufficiently wide frequency band and sufficient gain just by connecting wire materials even if used bundled without complicated efforts, and suitable reception sensitivity can be obtained.

For example, the reception sensitivity of the set improves 5 to 10 dB or so as compared to a conventional device, and accordingly, the reception sensitivity greatly improves (improvement of 5 to 10 dB over the conventional).

Also, the configuration is simple, manufacturing can be performed with low cost, and attachment can readily be performed.

Also, influence of the set is not readily received.

Further, for example, the antenna of the antenna device according to the present invention greatly differs from a film antenna principally used for mounting a conventional antenna device on a vehicle. Specifically, in the case of the film antenna, the antenna element on the film side is adhered to the front glass of the vehicle, and also, the GND of a coaxial wire is connected to the body of the vehicle since the body of a vehicle is commonly used as GND necessary for serving as an antenna. In this way, the film antenna serves as an antenna using the antenna element of the film, and the GND of the body of the vehicle, and electric waves received at the antenna thereof are input to a reception device.

On the other hand, a prominent feature of the antenna device according to the present invention is its difference from the above-mentioned film antenna in that the power supply cord and the antenna element are shared by using a portion of the power supply cord (e.g., in the case of a cord using a shield wire, a portion thereof obtained by separating high-frequency current flowing on the surface thereof using a ferrite having great high-frequency impedance) as an antenna element instead of the antenna element of a film. Also, the antenna device according to the present invention differs from the above-mentioned film antenna in that the antenna GND (antenna ground 120) of the board is served as an antenna instead of the body of the vehicle being used as GND. Also, the first through third embodiments including no antenna board portion differ from the above-mentioned film antenna in that the GND of the reception device, and the GND (shield portion 203) of the outer cover of the coaxial wire are used instead of using the body of the vehicle as GND. In this way, the antenna of the antenna device according to the present invention differs from a conventional film antenna, the user does not have to adhere a film antenna onto the front glass, and accordingly, convenience is high.

Further, with the fourth through seventh embodiments which share the UHF band, the antenna element such as the outer cover of the power supply cord is used for reception of the VHF band, and connected via a filter element (filter F111) which exhibits low impedance with the VHF band, and also exhibits high impedance with the UHF band, and thus, an antenna for two-frequency common use which receives the UHF band at the antenna board portion, and receives the VHF band at the antenna board portion and the antenna element of the power supply cord portion is realized.

REFERENCE SIGNS LIST

10, 10A, 10B, 10C, 10D, 10E, 10F antenna device
11 first antenna
12 second antenna
20 power supply cord
21 first power supply cord
22 second power supply cord
30 high-frequency signal cable
40 high-frequency blocking portion
41, 42 ferrite core
43 chip board
50, 50' mold portion
60 car plug
70 power supply connector
80 high-frequency handling plug

100 antenna board portion
110, 110A through 110F antenna element
120 antenna ground
130 first antenna element
140 second antenna element
150 balun (balanced-to-unbalanced transformer)

The invention claimed is:

1. An antenna device comprising:
a power supply cord capable of power transmission;
a connecting portion;
a high-frequency signal cable for extracting a high-frequency signal from said connecting portion; and
a high-frequency blocking portion disposed in two places in the length direction of said power supply cord;
wherein said power supply cord forms an antenna with a portion between two high-frequency blocking portions being connected to said connecting portion;
and wherein said high-frequency signal cable is connected to said power supply cord via said connecting portion.

2. The antenna device according to claim 1, wherein said high-frequency blocking portions are formed of ferrite with low impedance at a low frequency and high impedance at a high frequency.

3. The antenna device according to claim 1, wherein said high-frequency blocking portions are formed of a chip component for high-frequency isolation with low impedance at a low frequency and high impedance at a high frequency.

4. The antenna device according to any one of claims 1 through 3, wherein said connecting portion includes an antenna board portion where an antenna element is formed;
and wherein said antenna element includes
a first connecting portion to which said power supply cord is connected, and
a second connecting portion to which said high-frequency signal cable is connected.

5. The antenna device according to claim 4, wherein said power supply cord is split into a first power-supply cord and a second power-supply cord, said two high-frequency blocking portions are disposed on said first power supply cord side and said second power supply cord side;
and wherein the wire of a spilt portion between said two high-frequency blocking portions is connected to said first connecting portion of said antenna element;
and wherein said high-frequency signal cable is formed of a coaxial cable where a core wire and a shield portion are formed in a concentric shape, and said core wire is connected to a second connecting portion of said antenna element.

6. The antenna device according to claim 5, wherein said power supply cord is formed of a coaxial cable, the outer cover is removed at a split portion between said two high-frequency blocking portions, and said shield portion is connected to said first connecting portion of said antenna element.

7. The antenna device according to claim 5, wherein said power supply cord is formed of a coaxial cable with a core wire and a shield portion being formed in a concentric shape;
and wherein said first power supply cord is divided into two split power supply cords;
and wherein one edge portion of one of the split power supply cords, and one edge portion of the other split power supply cord are connected between said core wires and between said shield portions via said chip component;
and wherein the other edge portion of said one of the split power supply cords, and an edge portion of said second power supply cord are connected between said core wires and between said shield portions via said chip component at said first connecting portion of said first antenna element.

8. The antenna device according to claim 4, wherein said first connecting portion is connected to said first power supply cord via a filter.

9. The antenna device according to claim 4, wherein said first connecting portion and said chip component are connected between core wires and shield portions via a filter.

10. The antenna device according to claim 1, wherein an antenna board portion where a first antenna element and a second antenna element are formed is provided to the inside of said connecting portion;
and wherein said high-frequency signal cable extracts a high-frequency signal from said antenna board portion;
and wherein said power supply cord forms a first antenna with a portion between two high-frequency blocking portions being connected to said first antenna element;
and wherein said high-frequency signal cable is connected to said first antenna element and said second antenna element;
and wherein with said antenna board portion, a second antenna is formed by said first antenna element and said second antenna element.

11. The antenna device according to claim 10, wherein said high-frequency blocking portions are formed of ferrite with low impedance at a low frequency and high impedance at a high frequency.

12. The antenna device according to claim 10, wherein said high-frequency blocking portions are formed of a chip component for high-frequency isolation with low impedance at a low frequency and high impedance at a high frequency.

13. The antenna device according to any one of claims 10 through 12, wherein said first antenna element includes
a first connecting portion to which said power supply cord is connected, and
a second connecting portion to which said high-frequency signal cable is connected;
wherein said power supply cord is split into a first power supply cord and a second power supply cord, and said two high-frequency blocking portions are disposed on said first power supply cord side and said second power supply cord side;
and wherein the wire of a split portion between said two high-frequency blocking portions is connected to said first connecting portion of said first antenna element;
and wherein said high-frequency signal cable is formed of a coaxial cable with a core wire and a shield portion being formed in a concentric shape, said core wire is connected to a second connecting portion of said first antenna element, and said shield portion is connected to said second antenna element.

14. The antenna device according to claim 13, wherein said power supply cord is formed of a coaxial cable, the outer cover is removed at a split portion between said two high-frequency blocking portions, and said shield portion is connected to said first connecting portion of said first antenna element.

15. The antenna device according to claim 13, wherein said power supply cord is formed of a coaxial cable with a core wire and a shield portion being formed in a concentric shape;
and wherein said first power supply cord is divided into two split power supply cords;
and wherein one edge portion of one of the split power supply cords, and one edge portion of the other split power supply cord are connected between said core wires and between said shield portions via said chip component;

and wherein the other edge portion of said one of the split power supply cords, and an edge portion of said second power supply cord are connected between said core wires and between said shield portions via said chip component at said first connecting portion of said first antenna element.

16. The antenna device according to claim 13, wherein said first connecting portion is connected to said first power supply cord via a filter.

17. The antenna device according to claim 15, wherein said first connecting portion and said chip component are connected between core wires and shield portions via a filter.

18. The antenna device according to claim 10, wherein said second antenna element is formed as antenna ground;

and wherein said first antenna element is formed with a smaller size than said second antenna element, and is connected to said high-frequency signal cable via a matching element for adjusting input impedance at said second connecting portion.

19. The antenna device according to claim 10, wherein with said high-frequency signal cable, said core wire is connected to said second connecting portion directly or via a balanced-to-unbalanced transformer.

* * * * *